United States Patent [19]

Bonneau

[11] 4,046,161

[45] Sept. 6, 1977

[54] NON-RETURN VALVE FOR PREVENTING BACK FLOW OF WASTE WATERS

[76] Inventor: Benoit Bonneau, 470 Roberval St., Roberval, Quebec, Canada

[21] Appl. No.: 627,910

[22] Filed: Oct. 31, 1975

[30] Foreign Application Priority Data

Oct. 29, 1974 Canada ..... 212602

[51] Int. Cl.[2] ..... F16K 9/00

[52] U.S. Cl. ..... 137/247.17; 137/247.23; 137/449; 137/519.5; 210/123; 210/131

[58] Field of Search ..... 137/247.17, 247.21, 137/247.23, 386, 445, 449, 519.5; 141/215; 210/123, 131

[56] References Cited

U.S. PATENT DOCUMENTS

| | | | |
|---|---|---|---|
| 201,758 | 3/1878 | Downey | 137/519.5 |
| 1,318,545 | 10/1919 | Dehn | 137/247.23 |
| 1,700,636 | 1/1929 | Kuhn | 137/247.21 |
| 2,616,512 | 11/1952 | Coon | 137/519.5 |
| 2,638,308 | 5/1953 | Kell | 137/519.5 |
| 2,770,314 | 11/1956 | Powell | 137/247.17 |

FOREIGN PATENT DOCUMENTS

| | | | |
|---|---|---|---|
| 70,883 | 11/1915 | Switzerland | 137/519.5 |

*Primary Examiner*—Martin P. Schwadron
*Assistant Examiner*—G. L. Walton
*Attorney, Agent, or Firm*—Raymond A. Robic; Arthur Schwartz; Francis B. Francois

[57] ABSTRACT

A non-return valve comprising: a pipe for waste waters having a passageway for draining the waters in a downstream direction, a circular seat having a given diameter transversely disposed in said pipe and a housing opening into the passageway directly downstream and laterally with respect to the seat. The housing has an upper wall provided with a guiding strip transversely disposed with respect to the pipe and leaning in the upstream direction. A shutting ball, having a specific gravity lower than the specific gravity of the sullage and a diameter larger than the diameter of the seat is connected with the guiding strip so that the shutting ball can be brought to seat on the seat by floating on the waters in the case of an inopportune upstream back flow and be held into the housing when the waters are flowing in the normal direction.

6 Claims, 3 Drawing Figures

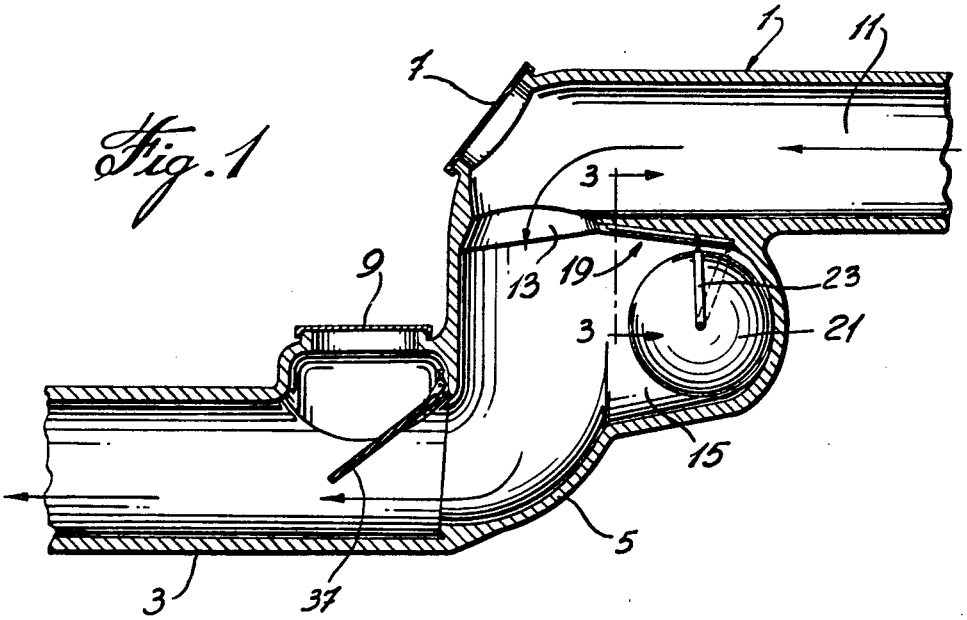
Fig. 1
1
11
7
3
9
13
19
23
21
15
5
37
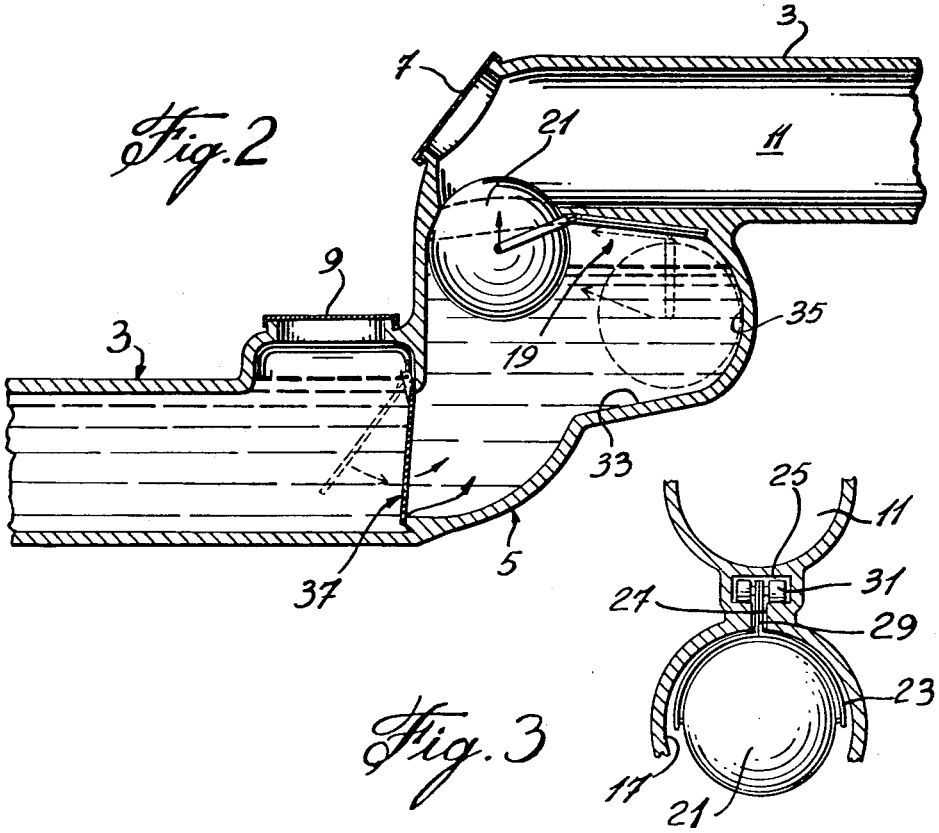
Fig. 2
3
7
21
11
9
35
19
33
5
37
25
31
27
29
23
17
21
Fig. 3

NON-RETURN VALVE FOR PREVENTING BACK FLOW OF WASTE WATERS

The present invention relates to a non-return valve for preventing the back flow of waste waters in a sewer, and more particularly, while not exclusively, preventing back flow in a domestic sewer.

Non-return valves are presently used in commonly known systems, which valves comprises a usually flat shutter pivoting about an axis located near the periphery thereof and extending transversally of the drain pipe. The shutter closes the pipe only in the case of a back flow of waste water therein, that is whenever the water flows backwards to the sink. Such valves present a drawback because the shutter is only occasionally operated and, as a consequence, rubbish accumulates along the pivoting axis, causing the shutter to rust so that it may well work inefficiently precisely when back flow occurs.

An object of the present invention is to provide a non-return valve that avoids the foregoing drawback.

Another object of the invention is to provide a non-return valve comprising a shutter which simultaneously pivots and slides when operated, thus reducing the risks of jamming due to an accumulation of rubbish and to rusting.

A further object of the invention is to provide a non-return valve comprising a shutter which can be completely withdrawn from the flow pipe into a housing shaped so as to be continuously washed and thus ensure a better removal of the rubbish than obtained in conventional systems.

More specifically, the non-return valve according to this invention comprises a waste waters drain pipe having a passageway for draining such waters in the downstream direction. The pipe comprises a circular seat transversely disposed with respect to the flow of water and having a given diameter; the pipe defining also a housing opening into the passageway directly downstream and laterally with respect to the seat. The housing has an upper wall provided with a guiding strip transversely disposed with respect to the pipe and leaning thereto in the upstream direction. The seat is to be closed by a shutting ball the specific gravity of which is lower then the specific gravity of the sewage water and the diameter of which is larger than the diameter of the seat. Means interconnect the shutting ball and the guiding strip so that the ball be carried, in a positive manner, by the waste water to be set on the seat in the case of an inopportune upstream back flow. These means are also meant to retain the shutting ball into the housing when the waste waters flow in the normal direction.

According to a preferred embodiment, the connecting means comprise a rigid stirrup member the legs of which are pivotably mounted, at their ends, onto the shutting ball about an axis passing through the center thereof, and of which the bight comprises means for slidably mounting it on the guiding strip. The latter means consists preferably of a partially closed slot along the guiding strip defining a linear passageway facing the housing, and a rod secured by one end to the bight of stirrup member, which rod runs through the linear passageway, and a holding element located at the other end of the rod and held in the slot to slide therein.

An embodiment of the invention will now be described with particular reference to the accompanying drawing wherein:

FIG. 1 is a longitudinal cross-section view of a non-return valve according to the invention, showing the valve when the sewage waters are drained off in the normal direction;

FIG. 2 is a view similar to FIG. 1 of the same non-return valve in its working position, in the case of an inopportune back flow of the sewage waters.

FIG. 3 is a section view taken on a plane passing through line 3—3 of FIG. 1, showing the mounting of the shutting ball of the guiding strip.

Referring now to the drawing, the illustrated non-return valve according to the invention comprises a waste or sewage water drain pipe made up of two parallel sections 1 and 3 respectively located upstream and downstream. Upstream section 1 and downstream section 3 communicate through a central section 5. The normal draining-off direction of the water is indicated in FIG. 1 by the arrows. Apertures 7 and 9 are provided for cleaning and checking up the valve, as in conventional installations. The aforesaid drain pipe forms a passageway 11 wherein the water is drained-off in the downstream direction.

Sections 1 and 5 are connected by means of a circular seat 13 transversely disposed with respect to the water flow. Central section 5 comprises a housing 15 opening into passageway 11 immediately downstream of the seat 13 and laterally thereto.

Housing 15 has an upper wall 17 provided along its center line with a guiding strip 19 transversely disposed with respect to the passageway 11 in section 5 and leaning towards seat 13 in the upstream direction.

Seat 13 is intended to be closed, as shown in FIG. 2, by a shutting ball 21 the specific gravity of which is lower than the specific gravity of the waste water so that it may be swept along and float on the waste water. As is shown, the diameter of shutting ball 21 is larger than the mean diameter of circular seat 13. Seat 13 is preferably slanted in the upstream direction and curved to ensure a firm contact with shutting ball 21.

Shutting ball 21 is connected with the guiding strip 19 by means of a rigid stirrup member 23 the end of the legs of which are pivotably mounted, in a conventional manner, by their extremities onto the center of the shutting ball 21 and of which the bight comprises means for mounting and sliding the ball along the guiding strip 19. The latter consists of a partially closed slot 25 defining a linear passageway 27 facing the housing 15. Stirrup member 23 is mounted in the guiding strip 19 by means of a rod 29, secured by one end to the bight of the stirrup-piece ear, extending across the passageway and kept in slot 25 by a holding means located at the other end. This holding means comprises rollers 31 supported by and sliding in the slot 25. The latter opens at its extremity contiguous to seat 13 to permit insertion of the rollers 31.

It can easily be seen that such an arrangement not only permits the shutting ball 21 to pivot about a diametrical axis but also sliding along the guiding strip 19. This arrangement allows the shutting ball 21 to positively move toward seat 13 and be fastened to the upper wall of housing 15.

It can be seen, more particularly in FIG. 2, that the housing 15 has a lower wall 33, opposite the guiding strip 19, which leans towards passageway 11 and has a back wall 35, which is concave 7 and connects with the guiding strip 19. Owing to this particular configuration, the housing 15 is continuously washed when the waste waters are drained in the normal direction, thus avoiding accumulation of rubbish therein.

The non-return valve according to the invention can be used together with a grated check valve 37 located in section 3 and intended for contacting a seat formed at the junction of sections 3 and 5. Grating 37 advantageously avoids any vermin to go up into the drain pipe.

I claim:

1. A waste waters non-return valve, comprising:

a drain pipe having a passageway for draining waste waters from an upstream to a downstream direction, a circular seat having a predetermined diameter transversely disposed in said pipe, and a housing contiguous to said seat downstream thereof and opening into said passageway, said housing extending laterally from said seat and said passageway and having an upper wall provided with a guiding strip extending transversely with respect to the pipe and being inclined in the upstream direction;

said passageway in the area of said housing being defined by a smooth inner wall portion whereby to prevent retainment along said wall portion of detritus carried by said waste waters;

a shutting ball having a specific gravity lower than the specific gravity of the waste waters and a diameter larger than the diameter of the seat, said housing having a size to completely contain said ball when such is in its inoperative position, whereby said ball does not then inhibit the flow of waste waters through said valve; and means carried by said shutting ball for slidably connecting said shutting ball with the guiding strip so that the shutting ball can be moved along said guiding strip out of said housing and brought in contact with the seat, in the operative sealing position thereof, by floating on the waste waters in the case of an inopportune upstream back flow. said shutting ball being held back into the housing in an inoperative position by said connecting means and by the waste waters when the waste waters are drained in the downstream direction past said housing.

2. A non-return valve as claimed in claim 1, wherein the connecting means comprise: a rigid stirrup member having a bight and two legs, the extremities of said legs being pivotably mounted onto the shutting ball about an axis passing through the center thereof; and sliding means carried by said bight and engageable with said guiding strip for mounting said stirrup member for sliding along the guiding strip.

3. A non-return valve as claimed in claim 2, wherein the guiding strip is a partially closed slot defining a linear passageway facing the housing, and the sliding means comprises a rod secured at one end thereof to the bight of the stirrup member, the other end of which rod runs through the linear passageway, and said other end of said rod carrying holding means thereon arranged to retain said rod and said stirrup engaged with said guiding strip.

4. A non-return valve as claimed in claim 1 wherein the drain pipe is made up of two parallel sections connected by a central section, which central section contains said housing.

5. A non-return valve as claimed in claim 4 wherein the parallel section located downstream of the seat communicates with the housing by means of a second seat and wherein a flat shutter is provided for closing said second seat.

6. A non-return valve as claimed in claim 1, wherein the housing has a lower wall opposite the guiding strip and leaning towards the passageway, and a back wall which is concave and connects with the upper wall of the housing so that the housing, owing to its particular shape, is continuously washed, when the waste waters are drained downstream.

* * * * *